US006131233A

United States Patent [19]

Bolton et al.

[11] Patent Number: 6,131,233

[45] Date of Patent: Oct. 17, 2000

[54] MOP HEAD

[75] Inventors: Stephen Bolton, Cowbridge, United Kingdom; Kyung-Jack Hong, Anyang, Rep. of Korea

[73] Assignees: Addis Housewares Limited, W. Glamorgan, United Kingdom; Daego Co. Limited, Kyungki-Do, Rep. of Korea

[21] Appl. No.: 09/164,305

[22] Filed: Oct. 1, 1998

[30] Foreign Application Priority Data

Oct. 3, 1997 [GB] United Kingdom ..... 9720905

[51] Int. Cl.[7] ..... A47L 13/20; A47L 13/24

[52] U.S. Cl. ..... 15/229.1; 15/228; 15/147.1; 428/376

[58] Field of Search ..... 15/207.2, 229.1, 15/228, 229.2, 229.3, 229.4, 229.5, 229.6, 229.7, 229.8, 229.9, 147.1; 428/376, 36.9, 36.91, 57

[56] References Cited

U.S. PATENT DOCUMENTS

| | | | |
|---|---|---|---|
| 1,566,544 | 1/1925 | Krebs . | |
| 1,930,044 | 10/1933 | Farquhar | 15/229.1 |
| 4,995,133 | 2/1991 | Newell . | |
| 5,227,228 | 7/1993 | Newell . | |

FOREIGN PATENT DOCUMENTS

| | | |
|---|---|---|
| 29622483 | 4/1997 | Germany . |
| 29701349 | 6/1997 | Germany . |
| 162695 | 12/1970 | Spain . |
| 346175 | 4/1931 | United Kingdom . |

OTHER PUBLICATIONS

Steinar K. Nilsen et al., "Micro–fibre Cloths, their cleaning effect, wear resistance, and effect on surfaces", The Second International Congress on Professional Cleaning, Jun. 3–4, 1997.

*Primary Examiner*—Robert J. Warden, Sr.
*Assistant Examiner*—Kaj K. Olsen
*Attorney, Agent, or Firm*—Volpe and Koenig, P.C.

[57] ABSTRACT

A mop head 1 comprising a body 5 having a connector 4 for connection to a mop handle (not shown), and a plurality of flexible elongate cleaning members 3 attached to the body 5. The members 3 comprise hollow tube-like members which are open at their ends remote from the body 5. The members 3 may be made from woven or non-woven fabric material, or foam-like material; a preferred form of material is microfibre cloth.

14 Claims, 1 Drawing Sheet

MOP HEAD

The present invention relates to mop heads, and to mops incorporating such mop heads.

BACKGROUND OF THE INVENTION

One type of mop head known in the art generally comprises a pad of sponge or other absorbent material to be applied to a surface to be cleaned, and a backing member to which the pad is mounted, the backing member itself being arranged to be secured to a handle to form a mop. While such mops are satisfactory for many purposes, one disadvantage they have is that they are unable to effectively clean small or unusually shaped surfaces.

An alternative mop head known in the art comprises a multiplicity of limp strips, strands or fibres of absorbent material, all mounted on a backing member which is itself secured to a handle to form a mop. Such mops often have limited absorbent properties, and require a substantial amount of detergent to produce effective cleaning.

SUMMARY OF THE INVENTION

The present invention seeks to provide a mop head which is capable of effective cleaning in small areas or on unusually shaped surfaces, and also to provide an absorbent mop head, which may permit smaller quantities of detergent to be used.

According to the present invention, there is provided a mop head comprising a cleaning element comprising a multiplicity of substantially tubular flexible elongate members, a body arranged to support said cleaning element and means for engagement of said body with a handle, and wherein each of said tubular elongate members is attached to said body and is open at its end or ends remote from the body.

The tubular construction of the elongate members provides enhanced absorbent properties for the cleaning element because of capillary action associated with the elongate members. Preferably the elongate members are of absorbent material. Such material may for example comprise a woven or non-woven or knitted fabric material, or may be a sponge material.

Preferably, the elongate members have some abrasive properties, which can help to alleviate damage to the surface when being cleaned by the need to employ separate harsh abrasive material. The cleaning element may enable the amount of detergent required to be substantially reduced.

In the preferred embodiment, the elongate members are made of a microfibrous material, such as a textile material of microfibrous yarn preferably having a denier of less than 1.0. Preferred microfibrous fibres are what are known in the art as "split" microfibres, typically of polyester and/or polyamide. Micro fibre yarn is composed of 70% polyester and 30% polyamide fabricated together by a cross section method. The fabrics will be either woven on one side (Terry) or on both sides of a polyester base yarn. The use of micro-fibre materials for cleaning purposes is known, and tests have shown that they are very effective in this role—see for example the paper entitled "Micro-fibre Cloths, their cleaning effect, wear resistance and effect on surfaces", by Steinar K. Nilsen, Ingar Dahl, Ole Jorgensen and Thomas Schneider, published at The Second International Congress on Professional Cleaning at Helsinki, Finland, Jun. 3–4 1997.

Each of the elongate members may take the form of a substantially rectangular flexible sheet member which is connected (typically by stitching, sewing or the like) along its longitudinal edges to form a respective tubular member. Alternatively, the tubular members may be made by tubular knitting or weaving or similar process to form a seamless tube.

Typically, the body comprises clamp means arranged to secure the cleaning element to the body.

In a first embodiment of the present invention, the cleaning element is attached to the body at intermediate positions along the longitudinal length of the elongate members. However, in a second embodiment of the present invention, the cleaning element may be attached to the body substantially at the ends of the elongate members.

Mop heads according to the invention can provide improved cleaning properties and therefore require the use of less detergent during the cleaning process.

According to a second aspect of the present invention, there is provided a mop comprising a mop handle engaged with the body of a mop head as hereinbefore described.

The invention may be more clearly understood from the following description, given by way of example only, with reference to the accompanying illustrative drawings, wherein:

DETAILED DESCRIPTION OF THE PREFERRED EMBODIMENTS

Figure 1:
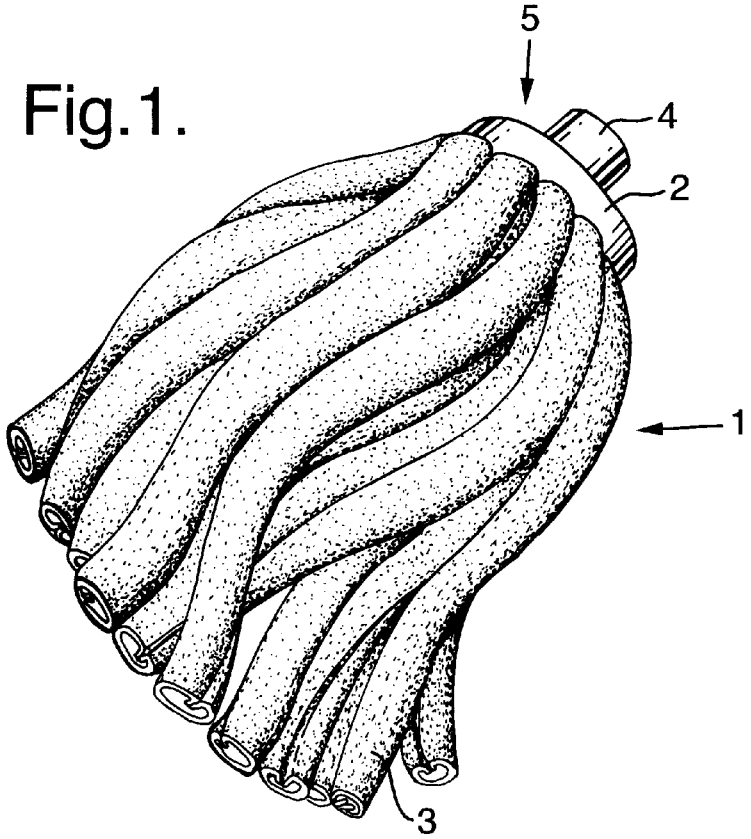
FIG. 1 is a perspective view of a mop head according to the invention.

Referring to FIG. 1, there is shown a mop head generally indicated by the numeral 1. The mop head 1 has a body 5 which comprises a clamp 2, to secure the floppy elongate hollow tube-like members 3 such that the tubes extend from the body and a connector 4 which is arranged to receive and connect to a handle (not shown).

Figure 2:
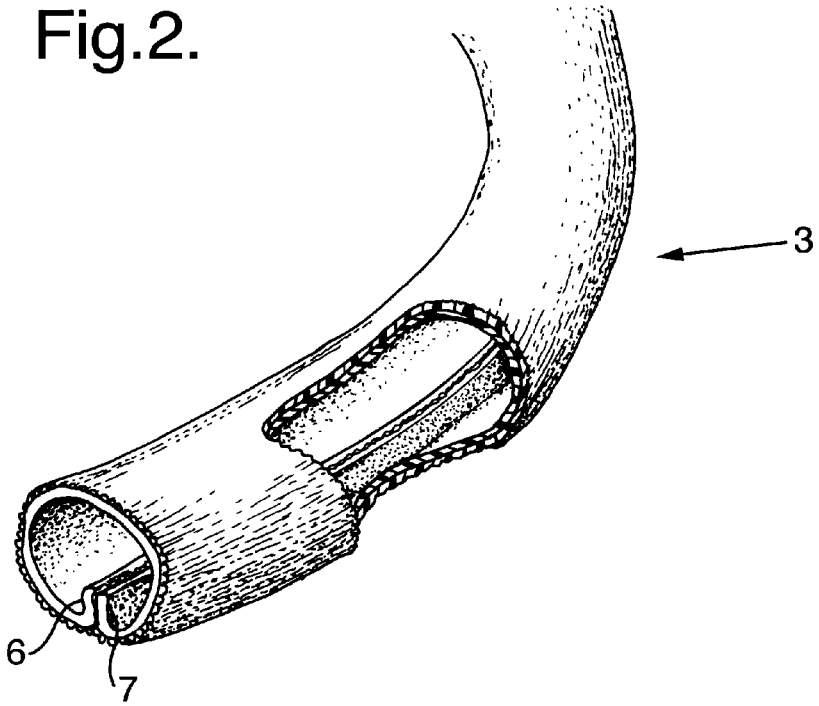
FIG. 2 is a perspective and cut-away view of an elongate member used in a mop head such as that of FIG. 1.

Referring to FIG. 2, where like reference numerals have been used to identify like parts corresponding to those in FIG. 1, the tube-like member 3 is made from a rectangular strip of microfibrous material. The strip is stitched together along its longitudinal edges 6 and 7, and everted to form a respective tube-like member 3 suitable for use in a mop head according to the invention.

What is claimed is:

1. A mop head comprising a cleaning element comprising a multiplicity of substantially tubular flexible elongate members (3), a body (5) arranged to support said cleaning element and means for engagement of said body with a handle, wherein each of said elongate members (3) is attached to said body and is open at at least one end remote from said body and wherein the elongate member (3) and each made of a sheet of material having edges which are brought together and attached to form a seam (6, 7), thereby creating the tubular form of said elongate members where said seam forms a longitudinal seam edge along the inner surface of the said tubular form.

2. The mop head as claimed in claim 1 wherein each of said tubular elongate members (3) is attached at one end to said body and at the other end is open.

3. The mop head as claimed in claim 1 wherein each of said tubular elongate members (3) is attached to said body at an intermediate position along its length, and is open at both ends.

4. The mop head as claimed in claim 3 wherein said intermediate position is approximately at a center point between the two ends.

5. The mop head as claimed in claim 1 wherein the seam is formed by stitching.

6. The mop head as claimed in claim 1 wherein said elongate members (3) are made from absorbent material.

7. The mop head as claimed in claim 1 wherein at least some of said elongate members (3) have abrasive properties.

8. The mop head as claimed in claim 1 wherein said elongate members (3) are made from textile material.

9. The mop head as claimed in claim 8 wherein the elongate members (3) are made from microfibrous material.

10. The mop head as claimed in claim 9 wherein said microfibrous material comprises a textile material of microfibrous fibres.

11. A mop head as claimed in claim 10 wherein the denier of said fibres is less than 0.1.

12. The mop head as claimed in claim 11 wherein said microfibrous fibres are "split" microfibres.

13. The mop head as claimed in claim 10 wherein said microfibrous fibres are "split" microfibres.

14. A mop comprising a mop head (1) comprising a cleaning element having a multiplicity of substantially tubular flexible elongate members (3) wherein the elongate members (3) are each made of a sheet of material having edges which are brought together and attached to form a seam (6, 7), thereby creating the tubular form of said elongate members, where said seam forms a longitudinal seam edge along the inner surface of the said tubular form, a body (5) arranged to support said cleaning element and means for engagement of said body with a handle, wherein each of said tubular elongate members (3) is attached to said body with at least one open end remote from said body, and a handle attached to said body.

* * * * *